US005788105A

United States Patent [19]

Foos

[11] Patent Number: 5,788,105

[45] Date of Patent: Aug. 4, 1998

[54] TAMPER EVIDENT THERMOFORMED PACKAGE

[75] Inventor: Douglas E. Foos, Barrington, Ill.

[73] Assignee: Plastofilm Industries, Inc., Wheaton, Ill.

[21] Appl. No.: 842,647

[22] Filed: Apr. 15, 1997

Related U.S. Application Data

[63] Continuation of Ser. No. 550,166, Oct. 30, 1995, abandoned.

[51] Int. Cl.[6] ..... B65D 55/02

[52] U.S. Cl. ..... 220/266; 206/1.5; 206/469; 206/807; 220/339

[58] Field of Search ..... 206/1.5, 461, 467, 206/469, 470, 471, 807; 220/4.22, 4.23, 265, 266, 268–270, 339; 229/226, 227

[56] References Cited

U.S. PATENT DOCUMENTS

| | | | |
|---|---|---|---|
| 3,351,270 | 11/1967 | Hohnjec | 220/339 |
| 3,786,982 | 1/1974 | Rakes et al. | 220/339 |
| 4,512,474 | 4/1985 | Harding . | |
| 5,092,516 | 3/1992 | Kastanek | 229/226 |
| 5,169,014 | 12/1992 | Hexamer | 220/4.22 |

FOREIGN PATENT DOCUMENTS

| | | |
|---|---|---|
| 1557699 | 2/1969 | France . |
| 2268711 | 11/1975 | France . |
| 665405 | 5/1988 | Switzerland . |

OTHER PUBLICATIONS

Article entitled "New T–E clamshell for Lancet device reassures HIV–conscious diabetics", reprinted from the Nov. 1995 issue of *Food & Drug Packaging*.

*Primary Examiner*—Jimmy G. Foster
*Attorney, Agent, or Firm*—Greer, Burns & Crain, Ltd.

[57] ABSTRACT

A reclosable package having visible evidence of tampering, where the package has a first portion, a second portion joined to the first portion along a common edge by a hinge integral to the first and second portions and thereby forming the package, and closure portions for locking the package, where the closure portions are removably connected to each of the first and second portions respectively. Upon first closure of the package, the closure portions engage each other, and upon first opening of the package, the closure portion become detached from the package.

12 Claims, 2 Drawing Sheets

TAMPER EVIDENT THERMOFORMED PACKAGE

This is a continuation of copending application Ser. No. 08/550,166, filed on Oct. 30, 1995, now abandoned.

BACKGROUND OF THE INVENTION

The present invention relates generally to thermoformed packaging used for shipping and/or storing products, and specifically to such a package having specialized fastener formations to provide readily visible evidence of tampering.

Inexpensive thermoformed packages are known for, among other things, conveying and storing drugs, foods, medical devices, contact lenses and contact lens-related cleaning and storage solutions. Such packages typically include a lid and a tray, which form the top and bottom of the package in opposed or face-to-face relationship. Such packages are typically molded or thermoformed of plastics such as polystyrene polyvinylchloride, polyethylene or other suitable materials.

A major disadvantage of available packages is that they provide no readily visible method for detecting tampering, or possible tampering, with the packaged products. This deficiency results in the user having no reliable method of detecting product tampering, other than opening the package and inspecting the contents. Furthermore, packages having some readily visible tampering indicator provide no way of closing and reusing the package.

Thus there exists a need for inexpensive packaging adaptable to multiple uses and providing readily-visible evidence of tampering with the package contents. There is also a need for such a package that, prior to use, may rest in a nested relationship with other such packages and, which after initial opening, is reclosable and reusable.

Accordingly, a first object of the present invention is to provide an improved package having specialized fastener formations that provide readily visible evidence of tampering.

A second object of the present invention is to provide an improved package having specialized locking formations that engage each other once, and, upon initial opening, become detached from the package.

Another object of the present invention is to provide an improved package having specialized closing formations constructed and arranged so that the package may be reclosable and reused after initial opening.

Yet another object of the present invention is to provide an improved package having specialized closing formations constructed and arranged so that the package may rest in a nested relationship prior to use.

SUMMARY OF THE INVENTION

The above-identified objects are met or exceeded by the present thermoformed package with two closeable portions, a lid and a tray. An important feature of the present package is that each of the lid and tray have a removable tab with a mating snap closure. Once the lid is initially closed upon the tray, the snap closures lockingly engage each other. Any attempt to open the package will result in the separation of the locked tabs from the package. In this manner, the missing tabs with the snap closures provide readily visible evidence of tampering with the package contents. Another feature of the present package is that the lid is configured to receive the peripheral wall of the tray for reclosing and reusing the package after initial opening. Further, the relationship of the snap closures, lid, tray and peripheral wall allow the open package to rest in a nested relationship with other such packages prior to use.

More specifically, the present invention includes a second portion joined to a first portion along a common edge by a hinge integral to the first and second portions. Further, the package includes a locking system employing closure portions that are removably connected to each of the first and second portions. Upon first closure of the package, the closure portions engage each other, and upon initial opening of the package, become detached from the package as a unit, leaving a visible gap in the package. An additional feature of the invention, includes a latch formation on the first and second portions so that, after initial opening, the package can be repeatedly reclosed.

Projecting laterally from each of the lid and tray is a peripheral lip, each defining a cutout and a gap. The two cutouts are in registry with each other, so that there appears to be only one opening when the package is closed. It is in these cutouts that the tabs are releasably attached. The gaps are offset from each other on the lip. In this manner, the user can use the offset gaps as grasping points for opening the package.

DESCRIPTION OF THE PREFERRED EMBODIMENT

Figure 1:
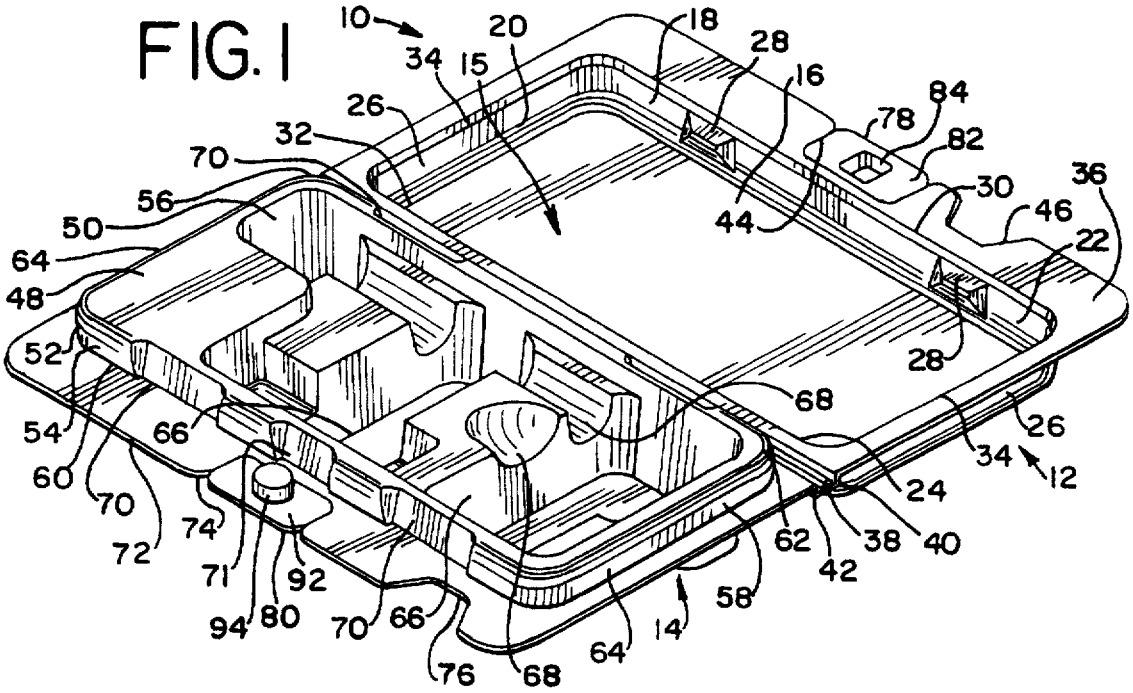
FIG. 1 is a perspective view of one embodiment of the present package in an open relationship.

Referring now to FIG. 1, a thermoformed package of the type suitable for use with the present invention is generally designated 10 and has two portions, a lid portion 12 and a tray portion 14. The lid 12 includes a main panel 16 having a skirt 18 depending from a peripheral edge 20 of the panel 16, the skirt 18 including a front, rear and side panels designated 22, 24 and 26 respectively. The panels 16,22,24, 26, together define a first recess 15. The front and rear panels 22 and 24 each have at least one, and preferably two, inwardly projecting latches 28 that matingly engage tray 14, discussed further below. Included on a common peripheral edge of the panels 22, 24 and 26 are front, rear and side edges, respectively designated 30, 32 and 34. A first lip 36 projects generally laterally from at least the front and side edges 30 and 34. The rear edge 32 partially forms a hinge 38 which integrally joins the lid 12 to the tray 14. In the preferred embodiment, common edges 40 and 42 of both the lid 12 and the tray 14 form the hinge 38.

The lip 36 projects generally laterally from the lid 12 and defines a generally rectangular shape, when viewed from above. Although a rectangular shape is preferred, other configurations are contemplated depending on the application. The lip 36 further defines at least two recessesd portions, the first recessed portion being a first gap, referred to hereafter as a cutout 44 and the second recessed portion being a first gap 46. The cutout 44 is an important feature of the present invention, as it is the structure which provides the user with readily visible evidence of tampering (best seen in FIG. 2).

Opposite the lid 12, the tray 14 includes a first planar portion 48 defining a second recess 50 with a peripheral wall 52 depending from the planar portion 48. The peripheral wall 52 has front, rear and side outer surfaces, respectively designated as 54, 56 and 58, having edges designated respectively as 60, 62 and 64. In addition, the second recess 50 has at least one, and preferably three, chambers each generally designated as chamber 66 for holding products, with at least one, and preferably three formations, each generally referred to as a formation 68, integrally formed to provide secure places for packaged articles, the shape of which depends on the application. As provided in the preferred embodiment, the first recess 15 has a distinct configuration from the second recess portion 50. However, it is contemplated that the recess as 15 and 50 may be of the same shape, depending on the application.

As indicated above, the package 10 is reclosable and reusable. This is accomplished by the first recess 15 being configured for receiving the peripheral wall 52, such that the front, rear and side outer edges 54, 56 and 58 frictionally engage the front, rear and side panels 22, 24 and 26 respectively in a tight fit. Further, the front and rear outer surfaces 54 and 56 each have at least one, and preferably two, indentations 70, which line up and are in registry with latches 28, wherein the latches 28 engage indentations 70 such that the package 10 may be reclosed. To further allow uninhibited access to the cutouts, the front outer edge 54 has at least one slot 71.

A second lip 72 projects generally laterally from at least the front and side edges 60 and 64. The rear edge 62 partially defines a portion of the lip 72 forming the hinge 38, which integrally joins the lid 12 to the tray 14. In the preferred embodiment, the common edges 40 and 42 of both the lid 12 and the tray 14 form the hinge 38. Further, the second lip 72 projects generally laterally from the tray 14 and defines a generally rectangular shape, when viewed from above. Although a rectangular shape is preferred, other configurations are contemplated depending on the application. Like the first lip 36, the second lip 72 further defines at least two recessed portions, the first recessed portion being a second cutout gap, referred to hereafter as a cutout 74 and the second recessed portion being a second gap 76.

Figure 2:
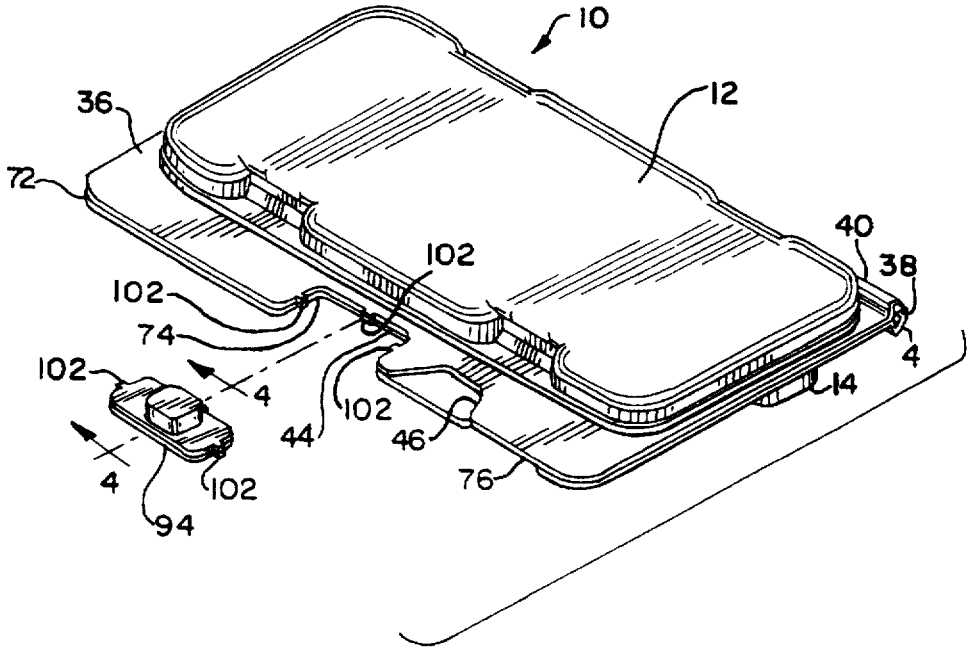
FIG. 2 is a perspective view of the package of FIG. 1 in a fastened, engaging relationship with the locked tabs shown exploded away.

Like the first cutout 44, the second cutout 74 is an important feature of the present invention, as, in conjunction with the first cutout 44, it provides the user with readily visible evidence of tampering (best seen in FIG. 2). In the preferred embodiment, the first and second cutouts 44 and 74 are lined up, and are in registry with, each other so that upon closure, the package 10 would appear to have only one cutout, as viewed from above (better seen in FIG. 2).

Similar to the first gap 46, the second gap 76 is a significant feature of the manner of reclosing and reusing the package 10, as it allows the user to open the package 10 after closing. The second gap 76 is partially offset from the first gap 46 so that they are not in registry with each other, as depicted in FIG. 2. In this relationship, the first and second gaps 46 and 76 can be used to pry open the package 10 after closing.

In the preferred embodiment, the first cutout 44 has at least one tab, generally referred to as a first tab 78, removably connected to it, while the second cutout 74 has at least one tab, referred to generally as a second tab 80, removably connected to it.

Figure 3:
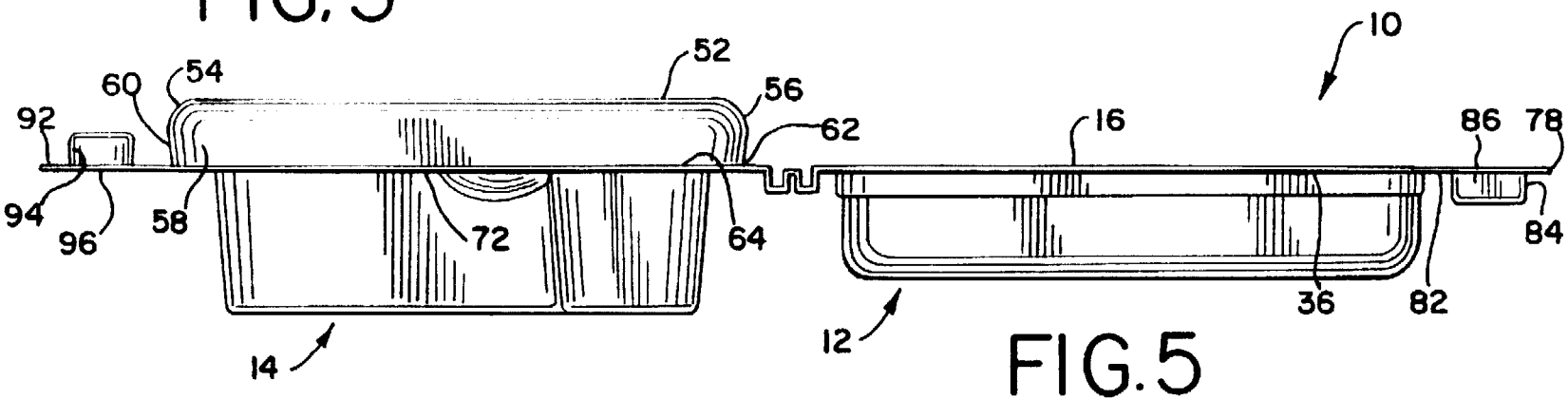
FIG. 3 is a side view of the package shown in FIG. 1.
Figure 4:
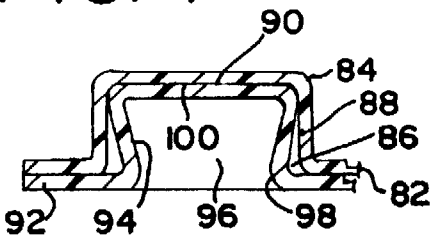
FIG. 4 is a sectional view taken along line 4—4 of FIG. 2 and in the direction indicated generally.

Referring now to FIGS. 3 and 4, the first tab 78 has a first planar surface 82 disposed coplanar with the first lip 36, and a first snap closure 84 integral to and depending from the first planar surface 82. The first snap closure 84 has a first recess 86 defined by an inner wall 88 and a inner planar surface 90, all of which generally define a "female" recess (best seen in FIG. 4). In the preferred embodiment, the first snap closure 84 has a generally cubical shape, but could be cylindrical or any other shape depending on the application.

Like the first tab 78, the second tab 80 has a second planar surface 92 on a plane with the second lip 72 (best seen in FIG. 3), with a second snap closure 94 being integral to and projecting vertically from the second planar surface 92. The second snap closure 94 has a second recess 96 defined by an outer wall 98 and an outer planar surface 100, all of which generally define a "male" formation (best seen in FIG. 4). In the preferred embodiment, second snap closure 94 has a generally cylindrical shape, but could be cubical or any other shape, depending on the application.

As with the tabs 78 and 80, the snap closures 84 and 94 are in registry with each other along or about the periphery of the tabs 78 and 80 respectively. From FIG. 4 it can be seen that the first snap closure 84 is configured for receiving the second snap closure 94. More specifically, this means that the outer wall 98 and outer planar surface 100 of the second snap closure 94 is frictionaly and lockingly engaged with the inner wall 88 and the inner planar surface 90 of first snap closure 84. This locking feature of the snap closures is important in providing readily visible evidence of tampering with the package, in that upon first closure of the package 10, when snap closures 84 and 94 are locked together, initial opening of the package 10 causes tabs 78 and 80 to become detached from cutouts 44 and 74 respectively (best seen in FIG. 2).

Of great importance to the readily visible evidence of tampering, a series of cuts are made in the lips 36 and 72 to form the tabs 78 and 80. However, in forming the cutouts 44 and 74, and thus the tabs 78 and 80, not all the material is removed. At least one, and preferably three, frangible connectors 102 are formed integral to and removably connecting the tabs 78 and 80 to cutouts 44 and 74 (best seen in FIG. 2). In the preferred embodiment, the connectors 102 are large enough to connect the tabs 78 and 80 to cutouts 44 and 74 during formation and initial closing, but small enough to be easily broken upon initial opening. In the process of forming package 10, in the preferred embodiment, the connectors 102 are created by a match metal punch process, however any other suitable die cutting type process is contemplated.

The subject invention is preferably thermoformed from a web of thermoformed materials, such as polystyrene, polyethylene or polyvinylchloride and can be labelled to identify the products therein whether such label (not shown) is integrally embossed during formation of package 10 or applied in a separate process or procedure.

Figure 5:
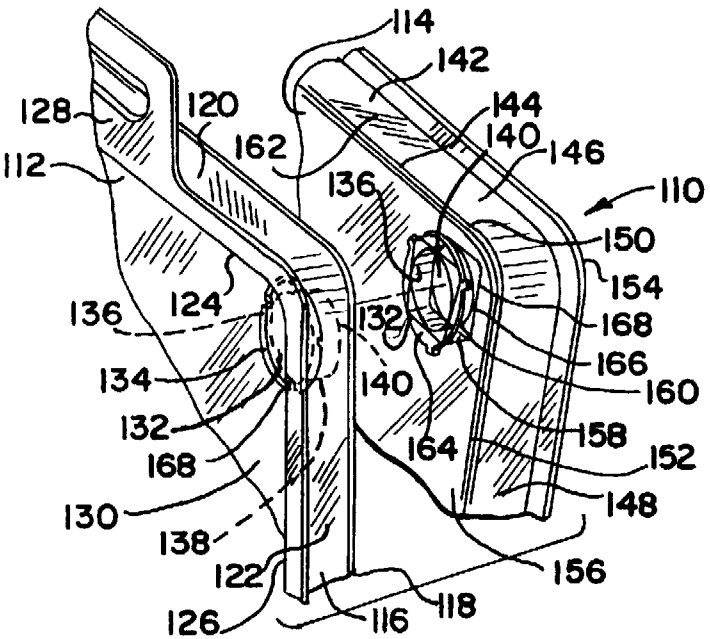
FIG. 5 is a fragmentary perspective view of a second embodiment of the invention.

Referring now to FIG. 5, a clamshell blister type package of the type suitable for use with the present invention generally designated 110 and has two portions, a lid portion 112 and a tray portion 114. The package 110 is shown in an open, non-engaging relationship, and is closed when the portions 112 and 114 are fastened to each other. Such packages are well known in the art, and are as described in U.S. Pat. No. 5,129,516 issued Jul. 14, 1992 and U.S. Pat. No. 5,245,152 issued Sep. 14, 1993, incorporated herein by reference. While numbered differently therefrom, the features of the body of the package 110 are similar to those of the package 10, and as such are not shown in FIG. 5, nor described in great detail. Only the tamper-evident features of the package 110 are explained in detail.

Like the lid portion 12, lid 112 has a first skirt 116 depending from a first peripheral edge 118 of the lid 112, the skirt 116 having a first front and first side panels designated 120 and 122 respectively. The front and side panels 120 and 122 each have an edge, referred to as a front and side edge, 124 and 126, respectively. The lid 112 further has a rear edge (not shown) in common with the rear edge (not shown) of tray 114 that forms a hinge (not shown) integral to the lid 112 and tray 114, similar to hinge 38 of package 10.

To form the readily visible evidence of tampering, the lid portion 112 further includes at least one first planar portion 130 having at least one, and preferably two, first snap closures 132 removably connected to it. In FIG. 5 the closure 132 is shown in phantom on the lid portion 112 and in solid lines engaged on the panel 114. This removable connection is formed by at least one first score line 134, removably joining the snap closure 132 to the planar portion 130. The first snap closure 132 has a first recess 136, defined by an outer wall 138 and an outer planar portion 140. Similar to the construction of package 10, this is an important aspect of the present invention, as it provides evidence of tampering.

Like the lid portion 112, the tray portion 114 has a second skirt 142 depending from a second peripheral edge 144 of the tray 114, the skirt 142 having front and side panels designated 146 and 148 respectively. The front and side panels 146 and 148 each have a front and side edge, 150 and 152, respectively.

To form the readily visible evidence of tampering, the tray 114 further includes at least one planar portion 156 having at least one, and preferably two, second snap closures 158 removably connected to it. Again, this removable connection is formed by at least one second score line 160, removably joining the snap closure 158 to the planar portion 156. The second snap closure 158 has a second recess 162, defined by an inner wall 164 and an inner planar portion 166.

In the preferred embodiment, the first snap closure 132 generally defines a "male" formation, where the first snap closure 132 has a generally cylindrical shape, but could be cubical or any other shape depending on the application. On the other hand, the second snap closure 158, generally defines a "female" recess, with a generally cubical shape, but could be cylindrical or any other shape depending on the application.

As in the case with package 10, the snap closures 132 and 158 are in registry with each other along the periphery of the lid portion 112 and the tray portion 114 respectively. Furthermore, the second snap closure 158 is configured for matingly receiving the first snap closure 132. More specifically, this means that the outer wall 138 and outer planar portion 140 of the first snap closure 132 are matingly locked with the inner wall 164 and inner planar surface 166 of the second snap closure 158. This feature of the snap closures, which is virtually identical to that shown in relation to FIG. 4, is important in providing readily visible evidence of tampering with the package, in that upon initial closure of the package, when snap closures 132 and 158 are engaged, opening the packages causes at least one, and preferably both, of the snap closures 132 and 158 to become detached from lid 112 and tray 114 respectively, providing readily visible evidence of tampering.

In forming the score lines 134 and 160 of the package 110, like package 10, not all the material is removed. At least one, and preferably three, connectors 168 are formed integral to and removably connecting the snap closures 132 and 158 to the planar portions 130 and 156 respectively. In the preferred embodiment, the connectors 168 are large enough to connect the during formation and initial closing, but small enough to be easily removable upon initial opening.

While a particular embodiment of the tamper evident thermoformed package of the invention has been shown and described, it will be appreciated by those skilled in the art that changes and modifications may be made thereto without departing from the invention in its broader aspects and as set forth in the following claims.

What is claimed is:

1. A reclosable package having visible evidence of tampering comprising:

a first portion;

a second portion joined to said first portion along a common edge by a hinge integral to said first and second portions and thereby forming said package;

a first lip projecting from said first portion and a second lip projecting from said second portion, said first and second lips each define at least one gap, which upon closure of said first portion upon said second portion, are in registry with each other; and locking means for locking said package including closure portions removably connected to each of said first and second portions respectively, whereby upon first closure of said package, said closure portions engage each other, and upon initial opening of said package, said closure portions become detached from said package.

2. The package of claim 1 wherein said locking means further include at least one snap closure of a first type integral to said first portion, at least one snap closure of a second type integral to said second portion, whereby each of said first type snap closure is configured for receiving a corresponding one of said second type snap closure.

3. The package of claim 1 wherein said locking means further includes at least one tab of a first type, having at least one snap closure of a first type, removably connected to one of said at least one gap on said first lip, and at least one tab of a second type, having at least one snap closure of a second type, removably connected to one of said at least one gap on said second lip, each said at least one snap closure of said first type configured for lockingly receiving one of said at least one snap closure of said second type.

4. The package of claim 1 further comprising a first lip integral to and projecting from said first portion, and a second lip integral to and projecting from said second portion.

5. The package of claim 4 wherein the first lip defines a first gap and the second lip defines a second gap, said gaps of said first and second portions being in registry with each other upon closure of said package.

6. The package of claim 5 wherein said locking means further includes at least one tab of a first type having at least one snap closure of a first type, removably connected to said first gap, and at least one tab of a second type having at least one snap closure of a second type, removably connected to said second gap, each of said first type snap closure is configured for lockingly accommodating a corresponding one of said second type snap closure.

7. The package as defined in claim 6 further including a second, offset gap on each of said first and second lips, said second gaps being laterally offset from each other for use in opening said package.

8. The package as defined in claim 1 further including a second gap on each of said first and second lips, said second gaps being laterally offset from each other for use in opening said package.

9. The package as defined in claim 1 further including latch means on at least one of said first and second portions for releasably securing said first portion to said second portion, said latch means being separate from said locking means and being configured so that upon the detachment of said locking means from said package, said latch means secures said first portion to said second portion.

10. A reclosable package having visible evidence of tampering comprising:

a first portion;

a second portion joined to said first portion along a common edge by a hinge integral to said first and second portions and thereby forming said package;

latch means on at least one of said first and second portions for releasably securing said first portion to said second portion; and locking means for locking said package including closure portions removably connected to each of said first and second portions respectively, whereby upon first closure of said package, said locking means portions engage each other, and upon initial opening of said package, said locking means become detached from said package;

said latch means being separate from said locking means and being configured so that upon the detachment of said locking means from said package, said latch means secures said first portion to said second portion.

11. The package of claim 10 wherein said first portion is a lid having a recess and said second portion is a tray having a peripheral wall extending generally vertically therefrom, said latch means including at least one latch disposed in said recess for tightly and releasably accommodating said wall.

12. A package having visible evidence of tampering comprising:

a lid portion having a recess;

a tray having a peripheral wall extending generally vertically therefrom and joined to said lid along a common edge by a hinge integral to said lid and said tray, said recess is configured for releasably accommodating said peripheral wall;

a first lip extending from said lid and a second lip extending from said tray, said first lip defining at least one gap of a first type, said second lip defining at least one gap of a second type disposed so that upon closing of said lid upon said tray, said corresponding gaps of said lid and tray are in registry with each other;

a tab of a first type, having at least one snap closure of a first type, being detachably connected to a corresponding one of said at least one of the first type gap in said lid, and at least one tab of a second type, having at least one snap closure of a second type, detachably connected to a correspondingly one of said least one gap in said tray, each of said first and second closures being constructed and arranged so that said snap closure of said lid lockingly engages said corresponding snap closure of said tray; and said first and second type tabs being configured so that upon initial opening of said engaged lip and tray, said first and second tabs detach from said corresponding lips.

* * * * *